US008056172B2

(12) United States Patent
Schneider et al.

(10) Patent No.: US 8,056,172 B2
(45) Date of Patent: Nov. 15, 2011

(54) APPLIANCE PANEL WITH INCREASED NATURAL FREQUENCY

(75) Inventors: Rick A. Schneider, St. Joseph, MI (US); Steven R. Fricke, St. Joseph, MI (US); Michael S. Short, St. Joseph, MI (US); James R. Sawyer, Monticello, IN (US); Phillip E. Lindeman, St. Joseph, MI (US); Michael R. Carey, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 2290 days.

(21) Appl. No.: 10/852,927

(22) Filed: May 24, 2004

(65) Prior Publication Data

US 2005/0257326 A1 Nov. 24, 2005

(51) Int. Cl.
*D06F 39/00* (2006.01)

(52) U.S. Cl. ..... 8/159

(58) Field of Classification Search ..... 8/159; 68/23.1; D32/6, 7, 8, 10, 11, 12, 13, 9; 336/90, 100; 312/228, 257.1, 265.5, 265.6
See application file for complete search history.

(56) References Cited

U.S. PATENT DOCUMENTS

| | | | | |
|---|---|---|---|---|
| D236,152 | S * | 7/1975 | Yamamoto | D32/8 |
| 3,976,269 | A | 8/1976 | Gupta | 244/119 |
| 4,497,387 | A * | 2/1985 | Reiplinger | 181/202 |
| 5,613,380 | A | 3/1997 | Savkar | 68/23.3 |
| 5,678,773 | A * | 10/1997 | Takamura et al. | 241/23 |
| 5,857,361 | A | 1/1999 | Jang | 68/23.2 |
| 6,460,949 | B2 * | 10/2002 | Jung | 312/228 |
| D465,308 | S * | 11/2002 | Resuello et al. | D32/6 |
| 6,615,619 | B2 | 9/2003 | Kakuda | 68/24 |
| 6,640,637 | B2 | 11/2003 | Baek | 73/652 |
| 6,691,536 | B2 | 2/2004 | Severns et al. | 68/12.27 |
| 7,016,744 | B2 * | 3/2006 | Howard et al. | 700/83 |
| 2002/0008448 | A1 | 1/2002 | Jung | |

FOREIGN PATENT DOCUMENTS

| | | | |
|---|---|---|---|
| DE | 8226335 | U1 | 2/1983 |
| DE | 8900298 | U1 | 8/1989 |
| GB | 2288505 | A | 10/1995 |
| JP | 52079578 | * | 7/1977 |
| JP | 04352994 | A | 4/1993 |

OTHER PUBLICATIONS

Park et al., Structure Optimization to Enhance its Natural Frequencies Based on Measured Frequency Response Functions, 2000, Journal of Sound and Vibration, 229(5), 1235-1255.*

Yee et al., Method for Shifting Natural Frequencies of Damped Mechanical Systems, Nov. 1991, American Institute of Aeronautics and Astronautics, 29 (11), 1973-1977.*

* cited by examiner

*Primary Examiner* — Michael Kornakov
*Assistant Examiner* — Nicole Blan
(74) *Attorney, Agent, or Firm* — Clifton G. Green; McGarry Bair PC

(57) ABSTRACT

A side panel for a fabric care appliance is described. The side panel includes an embossed pattern for increasing a first natural frequency (or first harmonic) of the side panel. Preferably, the first natural frequency is substantially higher than any ordinary operating frequency or driving frequency of the appliance. For example, in a washing machine, the first natural frequency of the side panel is preferably at least 1.6 times greater than the maximum rotational frequency of a drum or tumbler of the machine.

27 Claims, 7 Drawing Sheets

APPLIANCE PANEL WITH INCREASED NATURAL FREQUENCY

FIELD

The present invention relates to home appliances and more specifically to an apparatus for controlling vibration in a home appliance.

BACKGROUND

Vibration and noise are two significant customer complaint areas for home appliances such as clothes washing machines. In many cases, these two complaints are linked—excess vibration often leading to excess noise.

One source of vibration and noise can be side panels attached to each side of a washing machine. Side panels are commonly made of sheet metal and attached to the frame of the washing machine at the edges and/or corners of the panels. A vibration response pattern of a side panel may have several peaks, each peak representing a resonant or natural frequency of the side panel. By convention, the "first natural frequency" is the lowest natural frequency of the side panel. Likewise, the second natural frequency is the second lowest natural frequency, and so on. Operating the washing machine at a frequency near one of the side panel natural frequencies can result in a large resonant vibration response by the side panel.

In a washing machine, the primary driving frequency is created by the rotation of a drum (or tub) holding clothes inside the washing machine. The operating frequency of the washing machine is equivalent to the rotational frequency of the drum during operation. During a high-speed spin cycle, the rotational frequency of the drum may range from 0 Hz to 20 Hz or more. In that case, the rotational frequency of the drum may pass through one or more natural frequencies of the side panel, thus, causing resonant vibration.

One solution is to set the maximum operational frequency at a non resonant value, and, at the beginning of the spin cycle, quickly accelerate to the maximum operating frequency (thus, passing through the side panel natural frequencies). However, this approach still results in some resonant vibration. Additionally, in a high-speed spin cycle, the operating frequency may pass through several side panel frequencies, leading to further vibration.

Dampers and other shock absorbers can be helpful in reducing vibration and noise. However, those solutions require additional components and add weight to the washing machine. Minor additional structural stiffening has also been rejected because it was thought that increasing the first natural frequency of the side panel would cause the washing machine to pass through side panel resonance at a higher, more damaging speed.

Thus, a need exists for a washing machine side panel with a natural frequency that is significantly different from any operating frequency of the washing machine. Washing machines require many parts and are expensive to manufacture. It is therefore also desirable to have a lightweight, easily manufactured, and inexpensive means of reducing side panel vibration without increasing the number of components. Finally, side panel looseness or slack can also contribute to vibration, noise, and other problems. Thus, a further need exists for side panels with reduced looseness or slack.

Although these problems have been described in terms of clothes washing machines, other appliances also exhibit side panel vibration. For example, fabric driers, dish washers, standalone fans, appliances with incorporated fans, combination fabric care appliances and other devices may benefit from additional side panel vibration control.

SUMMARY

A washing machine side panel or surface that exhibits an improved vibration response is disclosed. According to an exemplary embodiment, the side panel has a first natural frequency that is substantially higher than a maximum operating frequency of the washing machine. This configuration avoids any large vibration response or resonance associated with operating the washing machine at a frequency near a natural frequency of the side panel.

In the exemplary embodiment, the side panel is a thin sheet of metal with a pattern embossed (or stamped) into the sheet. The embossed pattern generally contains a combination of ridges and valleys that are pressed into the sheet by dies (complementary male and female dies). According to the embodiment, the ridges and valleys are raised areas and shallow indentations respectively. Preferably, their imprint results in little change in thickness of the sheet. Once the side panel is attached to a washing machine, the ridges extend laterally away from the machine, while the valleys extend medially toward the interior of the machine.

Having a combination of ridges and valleys allows for a lower profile (embossing depth) than the use of either ridges or valleys alone. One problem with embossed ridges, however, is that the ridges increase the lateral profile of the washing machine. In addition, the ridges may be more easily dented or scratched because of their expanded profile. Thus, in a further embodiment, ridges are excluded, and the embossed pattern is a set of valleys configured to increase the natural frequency of the side panel.

In the exemplary embodiment, a washing machine associated with the side panel has a high-speed spin cycle. The high-speed spin cycle is useful for extracting water from fabric therein, thus allowing the fabric to dry more quickly. The operating frequency of the high-speed spin cycle may be 20 Hz, 25 Hz, or more (i.e., 1,200 RPM, 1,500 RPM, or more). According to an embodiment, the first natural frequency of the side panel is set to 40 Hz or, in a further embodiment, at least 1.6 times the operating frequency of the spin cycle to ensure that operating the washing machine under standard operating conditions does not cause a substantial frequency response at the side panels.

A number of embossed patterns may be used in order to achieve the increased first natural frequency. For example, a combination of ridges and valleys configured in arcs, loops, and crossing shapes, for instance, are available to create an embossment pattern. One skilled in the art will recognize that other embossing patterns may be used to increase the first natural frequency of the side panel. Additionally the depth of each ridge and each valley may be independently adjusted in the design.

According to one embodiment, each side panel comprises a separate piece of sheet metal. However, in alternative embodiments, the two side panels are interconnected by either a front or a back panel from the washing machine. For example, in an embodiment for a top-loading washing machine, the front panel and both side panels can be manufactured as a single metal sheet. Similarly, in an embodiment for a front-loading washing machine, the back panel and both side panels can be manufactured as a single metal sheet.

BRIEF DESCRIPTION OF THE DRAWINGS

An exemplary embodiment is described below in conjunction with the appended drawing figures, wherein like reference numerals refer to like elements in the various figures, and wherein.

DETAILED DESCRIPTION

1. Overview

Figure 1:
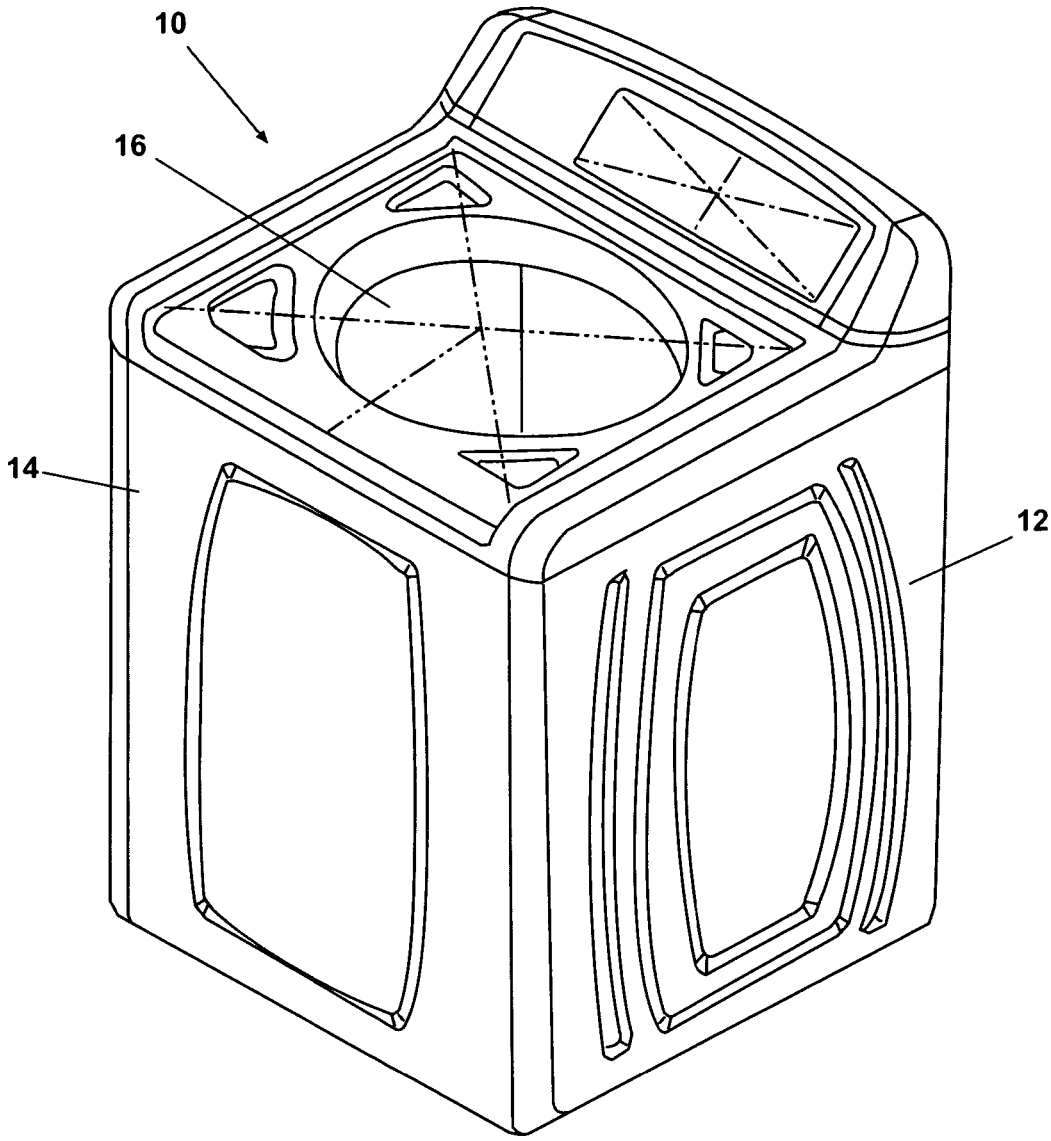
FIG. 1 is a perspective view of an embodiment of a washing machine in accordance with an embodiment.

FIG. 1 provides a perspective view of a top-loading washing machine 10 and is useful for providing an overview. A side panel 12 with an embossed pattern is attached to a lateral side of the washing machine 10. The embossed pattern is configured to increase a resonant frequency of the side panel 12.

A front panel 14 is attached to the front of the machine 10 and shares a common edge with the side panel 12. A drum 16 is accessible from the top of the machine 10. During wash, rinse, and spin cycles, the drum may agitate and spin at various frequencies and speeds in order to clean the clothes and to prepare clothes for drying.

Although not shown, a back panel and a second side panel are attached to a back of the machine 10 and a second lateral side of the machine 10. The second side panel preferably includes an embossed pattern. The panels provide a user protection from the electrical and mechanical systems of the machine. Additionally, the panels may serve as a sound buffer or serve other purposes.

Operational machinery within the machine 10 provides operational functionality for the machine. This machinery may include, motors, gears, belts, electrical, microprocessors, and other controllers, for example. One skilled in the art will recognize operational machinery that may be implemented within the washing machine 10 or other appliances. U.S. Pat. No. 5,219,370 entitled "Tumbling Method of Washing Fabric In a Horizontal Axis Washer", issued Jun. 15, 1993 provides additional discussion of the operation and components of a washing machine and is hereby incorporated by reference. Additionally, U.S. Pat. No. 4,784,666 entitled "High Performance Washing Process For Vertical Axis Automatic Washer", issued Nov. 15, 1988 provides further discussion of the operation and components of a washing machine and is hereby incorporated by reference.

During a spin cycle, a rotational frequency of the drum 16 can range from 0 Hz to 25 Hz or more depending upon the system design. The embossed pattern on the side panel 12 is useful for increasing the natural frequency of the side panel 12 to avoid resonant vibration caused by rotation of the drum 16.

The side panel 12 may exhibit a plurality of natural frequencies that may be seen as peaks in a frequency-response diagram. The natural frequencies are also termed harmonics. A first natural frequency of the side panel 12 has the lowest frequency of the plurality of natural frequencies. The embossed pattern of side panel 12 is configured so that its first natural frequency is substantially greater than the maximum rotational frequency of the drum 16. In a preferred embodiment, the first natural frequency is 1.6 times the maximum rotational frequency of the drum 16 during a high-speed spin cycle. Thus, for example, if the drum 16 is configured to spin at a maximum rotational frequency of 25 Hz then, in the preferred embodiment, the first natural frequency of the side panel 12 is preferably at least 40 Hz.

Frequency response diagrams for the side panel 12 may provide further assistance in determining whether the first natural frequency of the side panel 12 is high enough to avoid any significant resonance. There are several ways to determine the natural frequencies of a panel. For example, a physical model or prototype may be tested using a range of driving frequencies. Alternatively, a computer model may be used to calculate a frequency response.

2. Embossed Pattern

Formations can be formed in the side or front panels. Typically, a pattern of formations is embossed or stamped into a panel during manufacture. However, the formations may be formed using any other suitable method, such as molding, shaping, or bending, for example. Many variations in the pattern are available with equivalent functional properties. Thus, the embodiments provided should be seen as instructional examples rather than design limitations.

Figure 2:
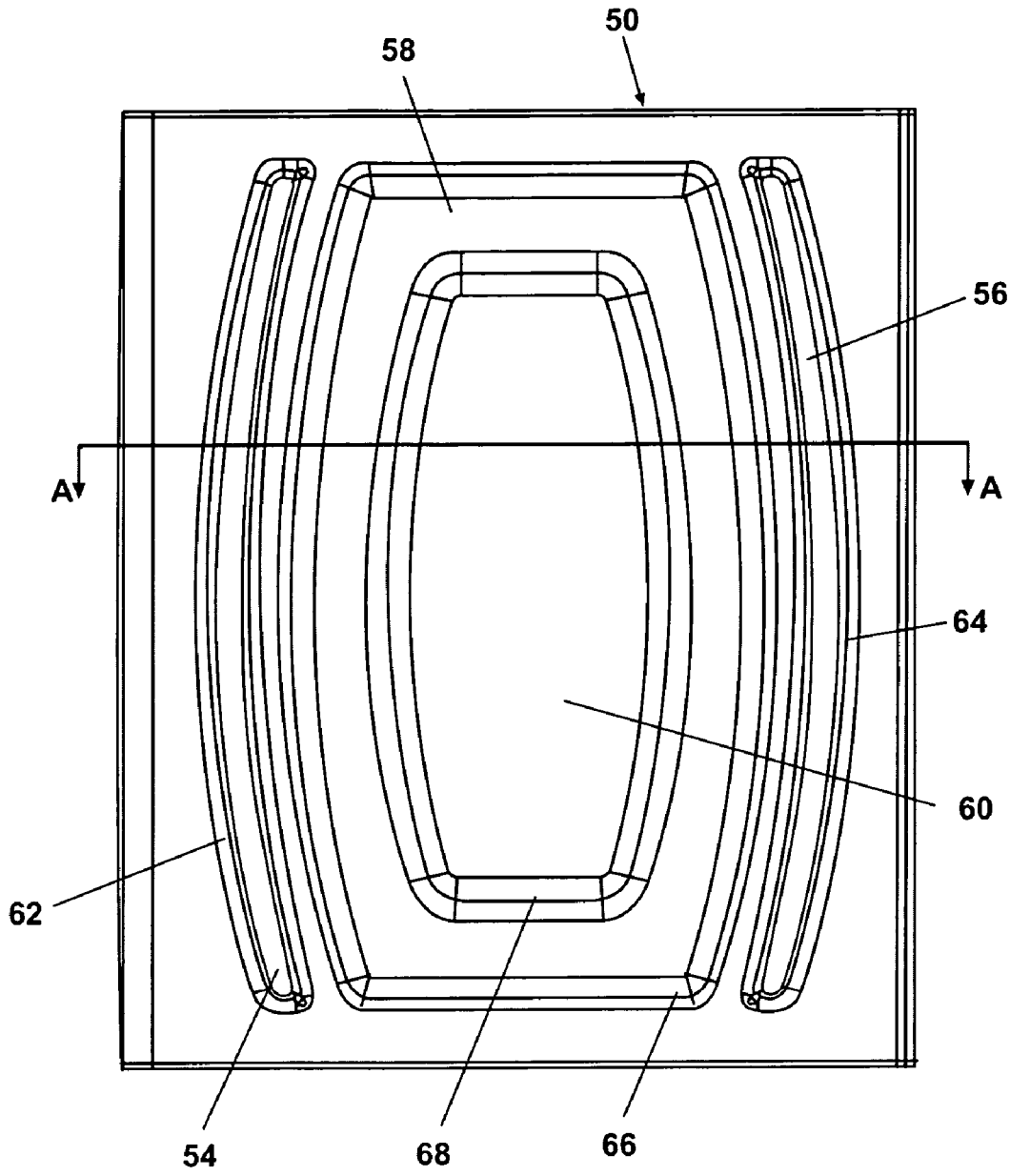
FIG. 2 is a front view of a side panel showing an embossed pattern in accordance with an embodiment.

FIG. 2 illustrates an embodiment of a side panel 50 with an embossed pattern. Preferably, the panel 50 is made from a thin sheet of steel or other metal that can be permanently deformed by a pair of die (male and female).

The embossed pattern in this embodiment comprises a set of ridges and valleys 54, 56, 58, 60. Generally, ridges are raised areas, and when manufacture is complete, appear as raised patterns on the outside of the associated appliance. Likewise, valleys are shallow indentations, and when manufacture is complete, appear as depressed patterns from the outside of the associated appliance. For this application, the term "formation" is defined to include either a raised area such as a ridge or a depressed area such as a valley. Thus, a formation may be either a ridge or a valley in the surface of the panel and can be made in any manner.

A first bowed ridge 54 is aligned toward a first side of the panel 50 and has a long axis running substantially from top to bottom of the panel 50. A second bowed ridge 56 may be a mirror image of the first bowed ridge 54. Accordingly, the second bowed ridge 56 is aligned toward a second side of the panel 50 and has a long axis running substantially from top to bottom of the panel 50. Bowed sloping regions 62, 64 are shown around the perimeter of the bowed ridges 54, 56. The bowed sloping regions 62, 64 allow for a smooth transition between a baseline panel depth and the bowed ridges 54, 56. Preferably, the sloping regions have a maximum rise angle of 60 degrees. However, various conditions may affect the rise angle such as material type, ridge height, ridge size, and requisite resonance characteristics of the side panel 50, for example.

A looping valley 58 is arranged between the two bowed ridges 54, 56. The looping valley 58 is in a loop or "O" shape. As with the ridges, the looping valley 58 is also shown with an exterior sloping region 66 around its perimeter. An interior sloping region 68 is also shown at the interior perimeter of the looping valley 58. The interior sloping region 68 has a greater rise than the other sloping regions because it interconnects the looping valley 58 with an interior ridge 60. The interior ridge 60 fills the interior perimeter of the looping valley 58. Section A-A is shown extending laterally across the panel 50.

The depth profiles of the ridges and valleys may vary according to the design. In one embodiment, the ridges are embossed at 4 mm above a panel baseline level, and the valleys are embossed at 7 mm below the panel baseline level. Thus, the perpendicular distance between a ridge and valley in this embodiment is 11 mm. Likewise, in another embodiment, the ridges are embossed at 3 mm above the panel baseline, and the valleys are embossed at 6 mm below the panel baseline level. In yet another embodiment, the embossed level of each ridge and each valley is independently configured. Although several exceptions exist, a greater embossed depth generally results in a greater first natural frequency of the panel.

Although the position of the embossed pattern is described according to a top and bottom of the side panel 50, the pattern may be configured at any angle, including 90 degrees or 175 degrees, for example. According to some embodiments, the orientation of the embossed pattern will depend upon a rotational axis of an attached appliance. Thus, for example, if the side panel 50 is attached to a fabric care machine with a substantially vertically oriented axis, then the embossed pattern may have a first orientation. Likewise if the side panel 50 is attached to a horizontal axis fabric care machine then the embossed pattern may have a second orientation. In a further embodiment, a perimeter of the embossed pattern is configured to encompass at least 70% of the area of the side panel.

Preferably, the side panel is made of sheet steel with a substantially uniform thickness of approximately 0.7 mm. In an alternatively described embodiment, the thickness is between 0.5 mm and 1 mm. Other thicknesses may also be used. Increased thickness may increase the first natural frequency of the panel. Other materials may also be used such as aluminum, galvanized steel, an alloy, plastic, other compound, or a multilayer composite, for example. The panels may be painted either before or after embossing the pattern. Special care should be taken if painting is done before embossing so that the paint is not unduly stretched or torn. Alternatively, the panel may be provided without paint—such as stainless steel.

Figure 3:
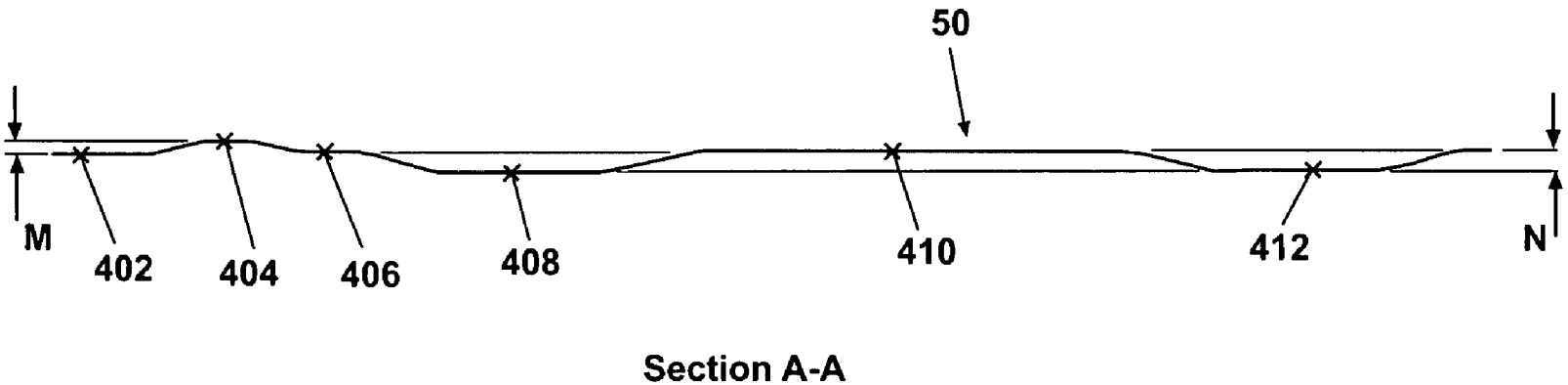
FIG. 3 is a top view of a portion of the side panel of FIG. 2 with some modifications.

FIG. 3 shows a top view of a portion of cross-cut A-A of FIG. 2 with some variations. This Figure may be useful as an embodiment of side panel 50 showing embossed depths. To aid in understanding, several points 402-412 are defined along the side panel 50. Beginning at a lateral edge of the side panel 50, point 402 is at an unembossed or baseline level. Point 404 is located on the first bowed ridge 54. The embossed height of point 404 is shown by distance M, and may be 4 mm, for instance. Point 406 is at an unembossed level between the first bowed ridge 54 and the looping valley 58. Points 408 and 412 are at the looping valley 58. Distance N represents the embossed depths of points 408 and 412, and may be 7 mm, for instance.

In FIG. 2, an interior ridge 60 is located within the inner perimeter of the looping valley 58. In FIG. 3, however, point 410 is located at a baseline level between points 408 and 412. Sloping regions that connect different embossed levels are shown having an approximately 30 degree angle. This angle can vary according to manufacturing specifications. Up to a point, increasing the sloping region angle increases the first natural frequency of the side panel 50. However, excessive angles may result in a relatively unstable or fragile area.

Figure 4:
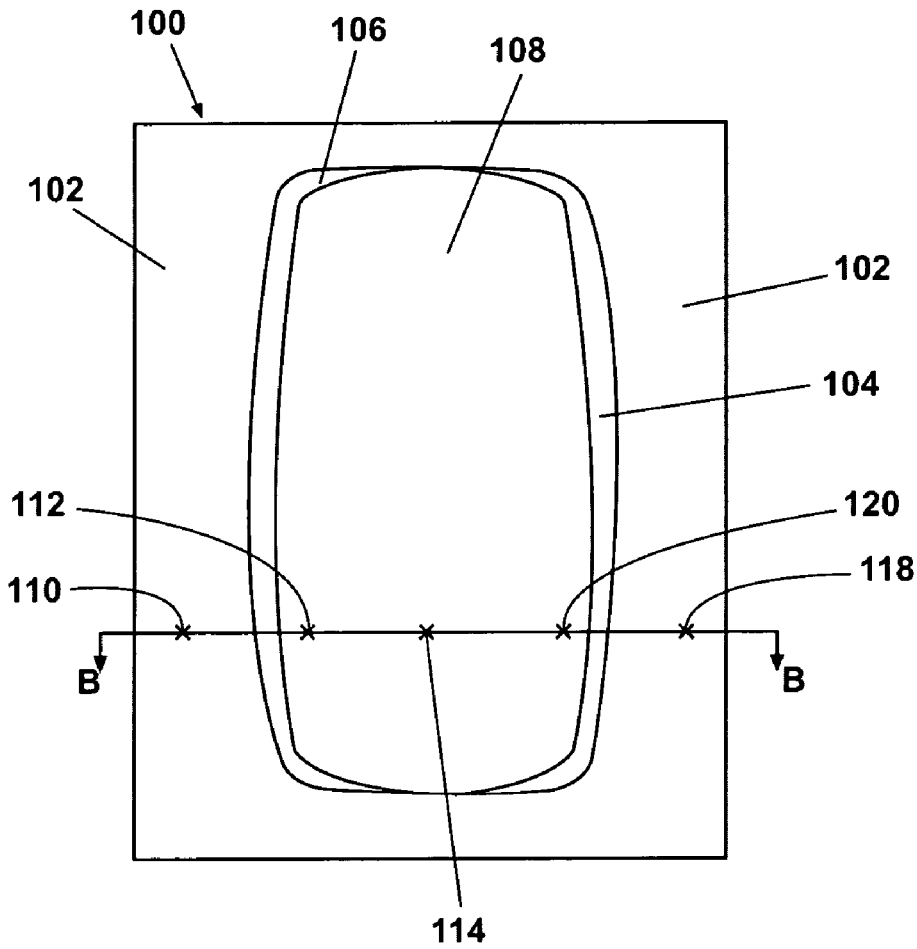
FIG. 4 is a front view of another side panel showing an embossed pattern in accordance with an embodiment.

FIG. 4 provides another embodiment of a side panel 100. A boundary portion 102 of the panel 100 is at an unembossed baseline depth. An arched center valley 108 is aligned toward the middle of the panel 100, and has a non-uniform embossed depth.

Two sloping edges 104, 106 link the boundary portion 102 with the arched center valley 108. Cross-cut B-B is shown crossing the elements of the panel 100. Various points are identified at cross-cut B-B: A first point 110 and a fifth point 118 are located in the boundary portion 102 of the panel 100 and have an embossed depth of 0 mm.

Second, third, and fourth points 112, 114, 120 on cross-cut B-B are located within the arched center valley 108. The second and fourth points 112, 120 are at lateral edges of the arched center 108. According to the embodiment, the second and fourth points 112, 120 have embossed depths of approximately 8 mm. The third point 114 is located toward the middle of the arched center valley 108 and has an embossed depth that is less than the embossed depth of the second and fourth points 112, 120. Accordingly, the third point 114 may have an embossed depth of 0 mm. Thus, the embossed depth within the arched center valley 108 varies across its surface.

Figure 5:
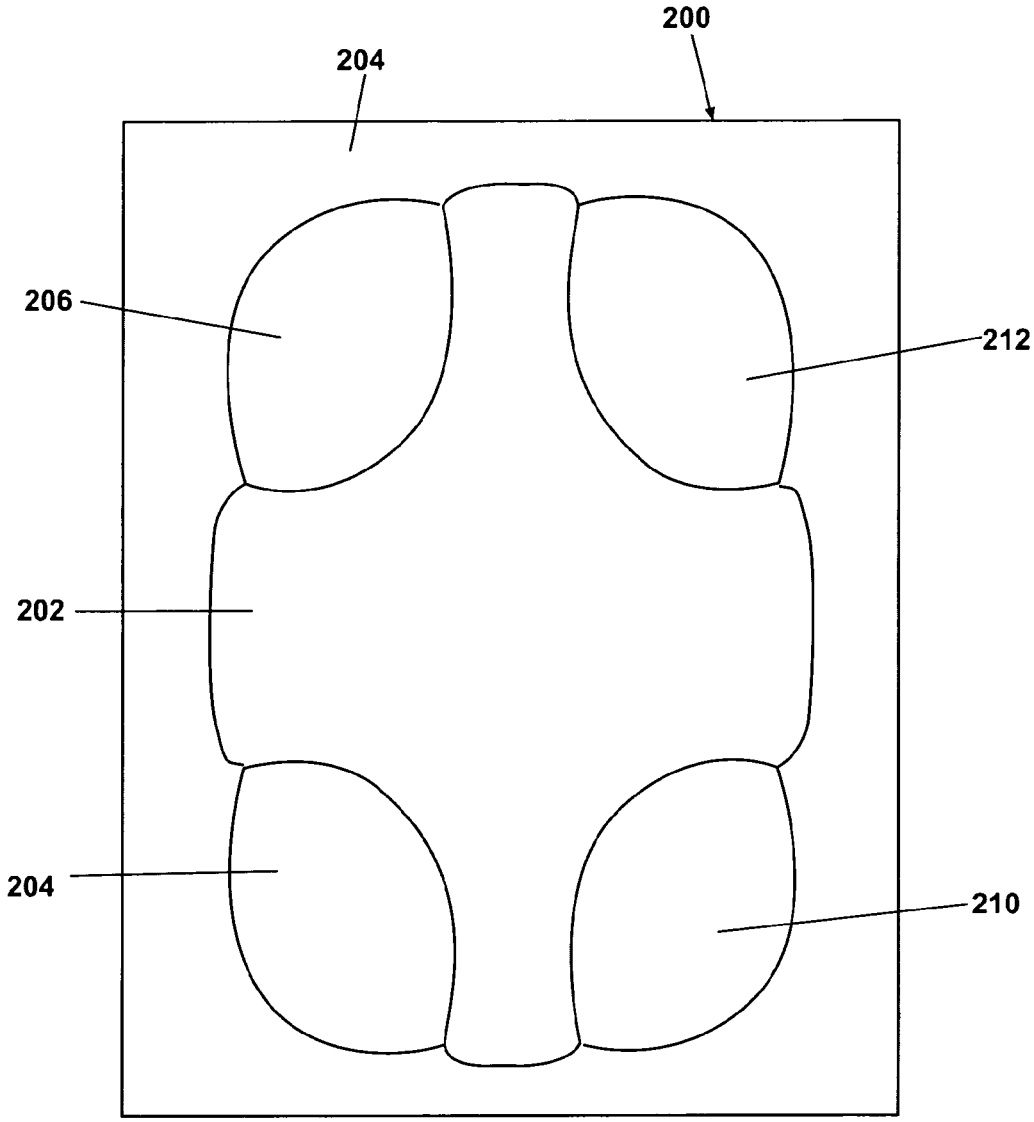
FIG. 5 is a front view of another side panel showing an embossed pattern in accordance with an embodiment.

Yet another embodiment of a side panel and embossed pattern is shown in FIG. 5. Side panel 200 has a cross-shaped embossed ridge 202, a boundary portion 204, and four embossed valley regions 206, 208, 210, and 212. Sloping regions (not shown) may interconnect the various regions or areas of the side panel 200.

Figure 6:
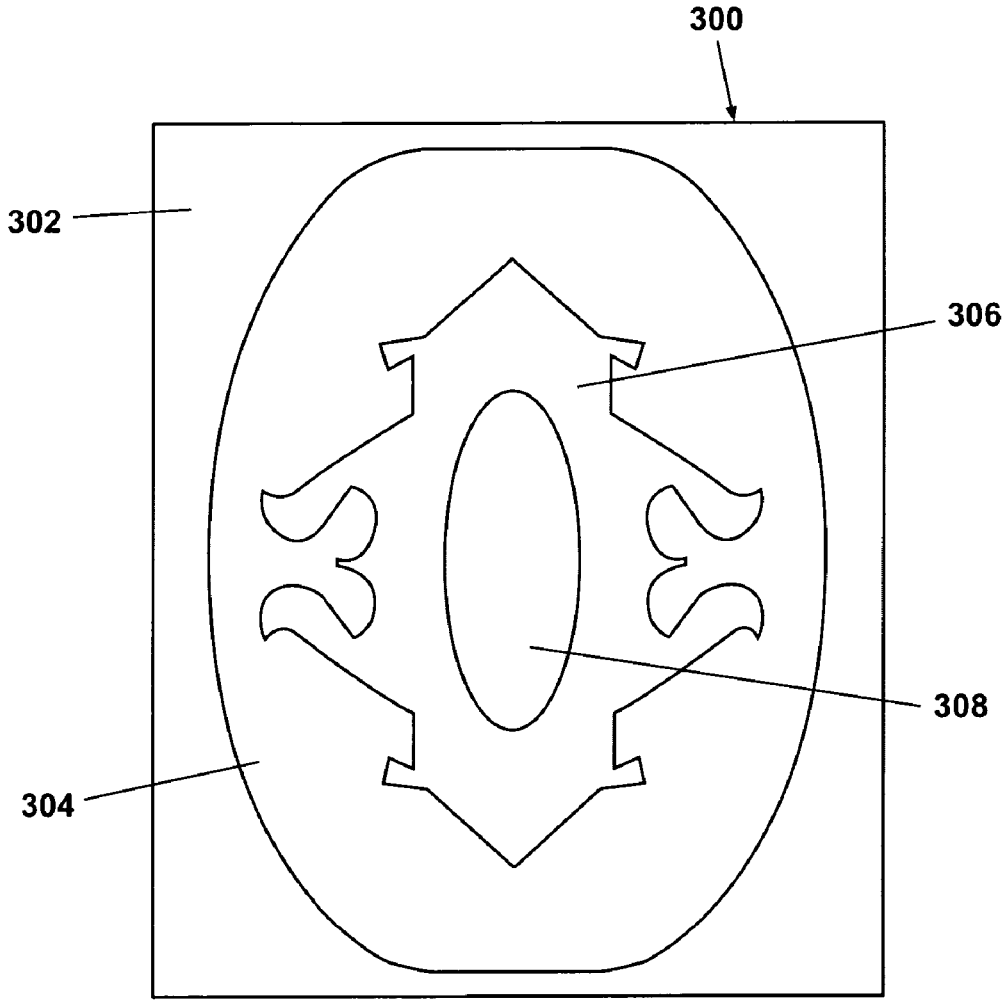
FIG. 6 is a front view of yet another side panel showing an embossed pattern in accordance with an embodiment.

FIG. 6 shows a modified side panel design based on a result from a finite element analysis design process. A side panel 300 has various ridges and valleys stamped into its surface. Center valley 308 is configured near the middle of the side panel 300 and may have an embossed depth of approximately 4 mm. Center valley 308 is shown having an oval shape. Other shapes, including regular and irregular shapes, are available. Irregular ridge 306 directly surrounds center valley 308 and may have an embossed height of approximately 3 mm. The non-standard shape of the irregular ridge 306 may be useful in increasing the first natural frequency of the side panel. An outer valley 304 surrounds the irregular ridge 306 and may have an embossed depth of approximately 3 mm. An unembossed edge 302 surrounds the embossed regions 304, 306, 308.

Various embodiments of an embossed pattern have been shown. More generally, the embossed pattern may be any configuration of ridges and/or valleys. Accordingly, an embossed pattern may be purely ridges or purely valleys. According to an embodiment, the embossment pattern increases a stiffness of the side panel, thus increasing a first harmonic or natural frequency. If the stiffness is increased to a sufficient level, then the first natural frequency of the side panel may be substantially above any operating frequency of the accompanying washing machine or appliance.

In a further embodiment, the embossed pattern is also useful for reducing looseness or slack in the side panel as well as noise.

Ridges and/or valleys in the panel may be created through a number of processes. For example, the panel may be stamped, embossed, rolled, extruded with embossment, cast or formed, or chemically hardened. Other methods of creating ridges and/or valleys in the panel are also available to one skilled in the art.

3. Side Panel Configuration

According to an embodiment, each side panel is an individual piece of sheet metal attached to the washing machine or appliance during manufacture. This configuration, however, may be more costly to manufacture, result in less stability, and be less consumer friendly than a panel unit that comprises several panels associated with a single piece of sheet metal.

Figure 7:
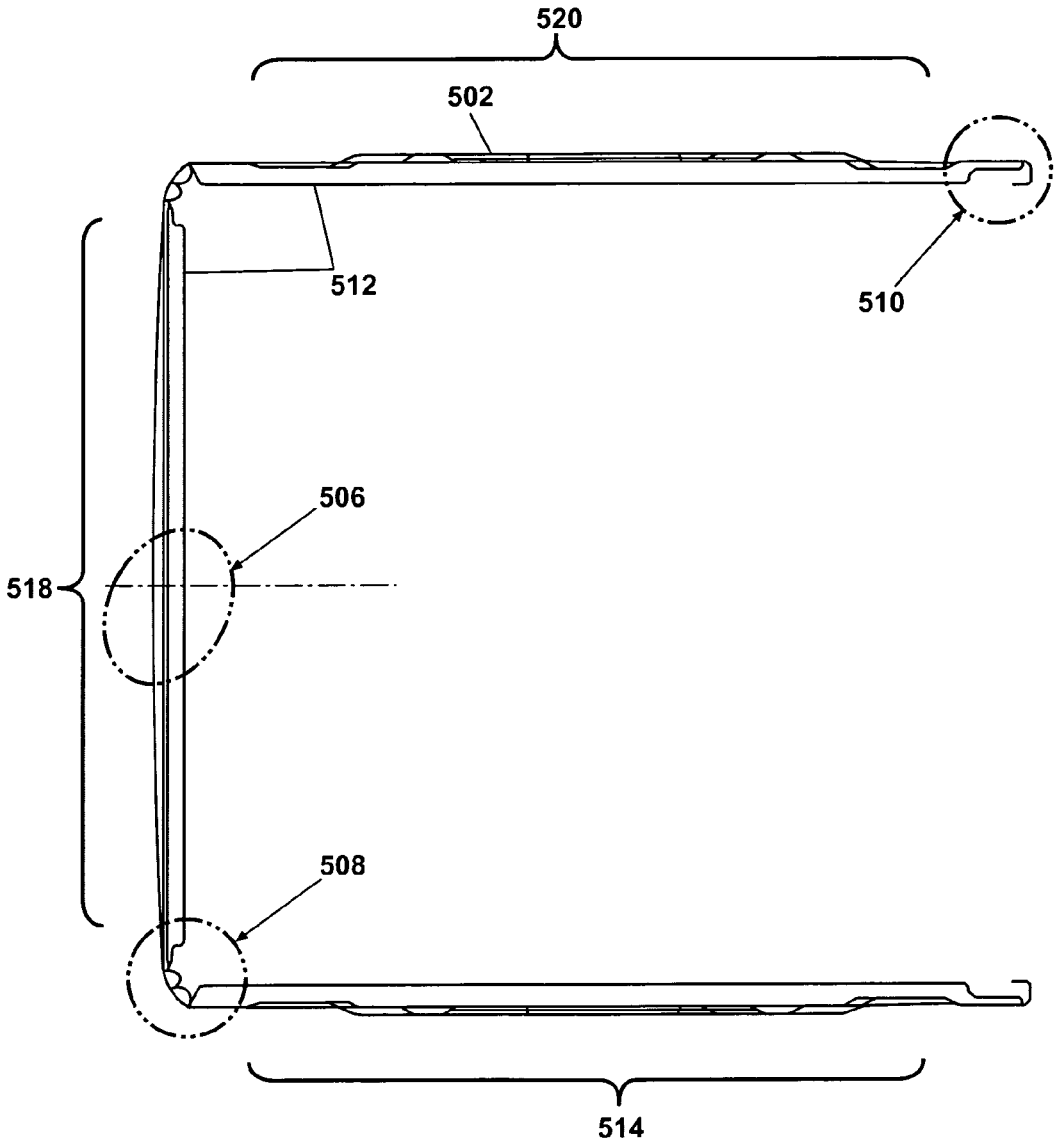
FIG. 7 is a top view of a panel unit in accordance with an embodiment.

FIG. 7 shows a top view of an embodiment of a panel unit having two side panels and a front panel configured as a single piece of sheet metal. A first side panel 514 and a second side panel 520 are interconnected by a front panel 518. An embossed pattern 502 is shown on the second side panel and is configured to raise a first natural frequency of the second side panel 520.

The front panel 518 has a bowed profile at area 506. The bowed profile serves to provide structural support and vibration control. A set of supports 512 may be bent portions of the sheet metal and may be useful for structural support, vibration control, and for providing attachment points, for instances. Likewise, end fixture 510 may serve similar purposes as the supports 512. A corner 508 may be designed to avoid sharp edges on an outside edge of the sheet. According to an embodiment, this panel unit may be installed on a substantially vertical-axis or top-loading fabric care machine Fabric care machines with a substantially horizontally oriented axis or front-loading capability may not have full front panels. Thus, in another embodiment, a panel unit comprises a back panel interconnecting two side panels. In further embodiments, panels other than the side panels (such as front or back panels) may include an embossed pattern for increasing natural frequency.

The side panels in other appliances, such as combination washers, dryers, dishwashers, and appliances containing fans, may also include embossed patterns for increasing the resonant frequency of the side panel.

4. Conclusion

A variety of embodiments have been described above. It should be understood that these are examples only and should not be taken as limiting the scope of the present invention. For example, the shape of the embossed pattern may be modified and achieve equivalent results. Likewise, alternative materials may be used. Further, the side panel configuration may be useful for appliances other than those named. Additionally, in many cases, the embossing orientation may be inverted so that ridges become valleys and valleys become ridges.

In order to maintain a manageable disclosure, elements in some embodiments were not repeatedly described although they may be implemented in other embodiments. Likewise, background elements that are well known to those skilled in the art were not further described although they may be a part of any of the embodiments.

Therefore, all embodiments that come within the scope and spirit of the following claims and their equivalents are claimed as the invention.

We claim:

1. An appliance having a maximum driving frequency comprising:

a panel attached to the appliance, the panel having a first natural frequency that is greater than the maximum driving frequency of the appliance.

2. The appliance of claim 1, wherein the panel comprises a thin metal sheet.

3. The appliance of claim 2, wherein the thin metal sheet has a thickness of between 0.5 mm and 1.0 mm.

4. The appliance of claim 2, wherein the thin metal sheet has a thickness of approximately 0.7 mm.

5. The appliance of claim 1, wherein the first natural frequency of the panel is at least 1.6 times greater than the maximum driving frequency of the appliance.

6. The appliance of claim 1, wherein the appliance is a fabric care machine including a rotatable drum.

7. The appliance of claim 6, wherein the rotatable drum includes a maximum rotational frequency that defines the maximum driving frequency of the appliance.

8. The appliance of claim 1, wherein the first natural frequency is 40 Hz or more.

9. The appliance of claim 1, wherein the panel comprises one or more formations that set the first natural frequency of the panel higher than the maximum driving frequency of the appliance.

10. The appliance of claim 9, wherein the one or more formations comprise an embossed pattern.

11. The appliance of claim 10, wherein the embossed pattern has an embossed height of less than 5 mm, and wherein the embossed pattern has an embossed depth of less than 8 mm.

12. The appliance of claim 10, wherein the embossed pattern comprises a set of ridges and valleys.

13. The appliance of claim 10, wherein the embossed pattern comprises a set of ridges.

14. The appliance of claim 10, wherein the embossed pattern consists of a set of valleys.

15. The appliance of claim 10, wherein the embossed pattern encompasses 70% or more of a surface area of the panel.

16. The appliance of claim 10, wherein the embossed pattern is further configured to reduce noise generated by the panel during operation of the appliance.

17. A washing machine comprising:

a rotatable drum having a maximum rotational frequency;

a panel having a first natural frequency that is greater than the maximum rotational frequency of the rotatable drum.

18. The washing machine of claim 17, wherein the first natural frequency of the panel is at least 1.6 times greater than the maximum rotational frequency of the rotatable drum.

19. The washing machine of claim 17, wherein the panel comprises a single piece of sheet metal.

20. The washing machine of claim 17, wherein the panel is a first side panel and the washing machine further comprises a second side panel disposed about the rotatable drum and having a first natural frequency that is greater than a maximum rotational frequency of the rotatable drum.

21. The washing machine of claim 20, wherein the first and second side panels each comprises one or more formations that set the first natural frequency of the respective panel higher than the maximum rotational frequency of the rotatable drum.

22. The washing machine of claim 17, wherein the washing machine further comprises a front panel having a bowed profile.

23. The washing machine of claim 17, wherein the panel comprises one or more formations that set the first natural frequency of the panel higher than the maximum driving frequency of the rotatable drum.

24. A method of operating an appliance with a rotatable drum comprising:

rotating the drum at a maximum rotational frequency that is less than a first natural frequency of an attached side panel.

25. The method of claim 24, wherein the maximum rotational frequency is at least 25 Hz.

26. The method of claim 24, wherein the first natural frequency of the attached side panel is at least 40 Hz.

27. The method of claim 24, wherein the first natural frequency of the attached side panel is at least 1.6 times the maximum rotational frequency.

* * * * *